US005987646A

United States Patent [19]

Bolmer

[11] Patent Number: 5,987,646

[45] Date of Patent: Nov. 23, 1999

[54] PADDED BATTING GLOVE

[76] Inventor: Stephen G. Bolmer, 3950 Overland Heights, Greensboro, N.C. 27407

[21] Appl. No.: 09/250,913

[22] Filed: Feb. 16, 1999

Related U.S. Application Data

[63] Continuation-in-part of application No. 09/129,190, Jul. 24, 1998, abandoned.

[51] Int. Cl.[6] ..... A41D 19/00

[52] U.S. Cl. ..... 2/161.1; 2/16; 2/163; 473/458

[58] Field of Search ..... 2/16, 21, 159, 2/161.1, 161.2, 161.3, 161.4, 161.5, 161.6, 161.8, 163, 167; 273/108.3, 317.6; D29/117; 473/205, 450, 451, 453, 458

[56] References Cited

U.S. PATENT DOCUMENTS

| | | | |
|---|---|---|---|
| 4,295,229 | 10/1981 | Clark et al. | 2/20 |
| 4,484,359 | 11/1984 | Tirinen | 2/20 |
| 4,561,122 | 12/1985 | Stanley et al. | 2/20 |
| 4,757,555 | 7/1988 | Gold | 2/16 |
| 4,793,005 | 12/1988 | Hetzel et al. | 2/161 |
| 4,930,162 | 6/1990 | Cote | 2/161 |
| 5,184,815 | 2/1993 | Maddox | 273/26 |
| 5,218,719 | 6/1993 | Johnson | 2/19 |
| 5,295,269 | 3/1994 | Ballard | 2/18 |
| 5,542,126 | 8/1996 | Harvanek | 2/161.2 |
| 5,604,934 | 2/1997 | Willet | 2/161.1 |
| 5,689,828 | 11/1997 | Mah | 2/16 |
| 5,706,521 | 1/1998 | Haney | 2/160 |
| 5,758,364 | 6/1998 | Rewoldt | 2/160 |
| 5,806,091 | 9/1998 | McHugh | 2/20 |
| 5,890,228 | 4/1999 | Wagner | 2/160 |

*Primary Examiner*—Diana Oleksa
*Assistant Examiner*—Katherine M Moran

[57] ABSTRACT

A pair of batting gloves comprises a dominant hand glove and an off hand glove wherein the dominant hand glove includes padding which covers the entire length of the thumb, the knuckles of the fingers, the center of the back of the dominant hand, and the juncture between the thumb and forefinger. The off hand glove lacks the web pad which covers the juncture between the thumb and forefinger and the thumb tip is exposed to provide a better grip on the bat.

9 Claims, 3 Drawing Sheets

PADDED BATTING GLOVE

This application is a continuation-in-part of and makes a claim of priority to application Ser. No. 09/129,190 filed Jul. 24, 1998, now abandoned the entire contents of which are incorporated by reference herein.

BACKGROUND OF THE INVENTION

1. Field of the Invention

This invention pertains to a modified batting glove which includes extra padding to protect a batter's hands.

2. Description of the Prior Art and Objectives of the Invention

Batting gloves are well known and understood in the art. Unfortunately, conventional batting gloves provide little protection for the batter's hands. Fast balls striking a batter's hands may inflict serious injury. While experienced batters may move out of the way of misthrown balls, individuals learning to bat may not realize that the ball has been misthrown and thus not move their hands resulting in injury as the ball strikes their hands. Even the greatest batters in the world may be subject to injury, especially because they must face the greatest pitchers in the world who sometimes throw inside and at the hands in an unexpected manner.

Thus, with the above concern in mind,. it is an objective of the present invention to provide gloves similar to a modern ski glove, although made with a more rigid and jointed foam, rather than a soft one-piece foam, which protect the hands of a batter as he learns to bat.

It is a further objective of the present invention to provide a pair of gloves, one of which includes padding over the webbing between the thumb and forefinger of the dominant hand.

It is a further objective of the present invention to provide a pair of gloves with padding covering the fingers that has been molded to allow easy finger motility.

These and other objectives and advantages will become readily apparent to those skilled in the art upon reference to the following detailed description and accompanying drawing figures.

SUMMARY OF THE INVENTION

The aforedescribed objectives and advantages are realized by providing a pair of gloves, one for the dominant hand and one for the off hand of a batter. Initially, these gloves are conventional batting gloves with VELCRO® wrist closures such as those sold by RAWLINGS®. Such gloves may be leather, synthetic or a combination of leather and synthetics. Sewn or otherwise joined to these conventional gloves are a series of pads. On the dominant hand glove, eight pads are sewn. One pad covers each finger back, including the thumb, while two pads cover the back of the hand in an abutting configuration. The last pad is a web pad which covers the webbing on the hand between the thumb and forefinger. Each of the finger pads includes a joint over each knuckle to facilitate easy bending of the fingers. The off hand glove is identical to the dominant hand glove except that it lacks the web pad. Additionally, the thumb pad is not as long as the thumb pad on the dominant hand glove, thus exposing the tip of the underlying glove for better gripping of the thumb.

In an alternate embodiment, the palm of the gloves may be covered with a polymeric foam, or other resilient foam material to increase the friction with which a bat may be grasped and provide shock absorption when hitting the ball.

DETAILED DESCRIPTION OF THE PREFERRED EMBODIMENT AND OPERATION OF THE INVENTION

Figure 2:
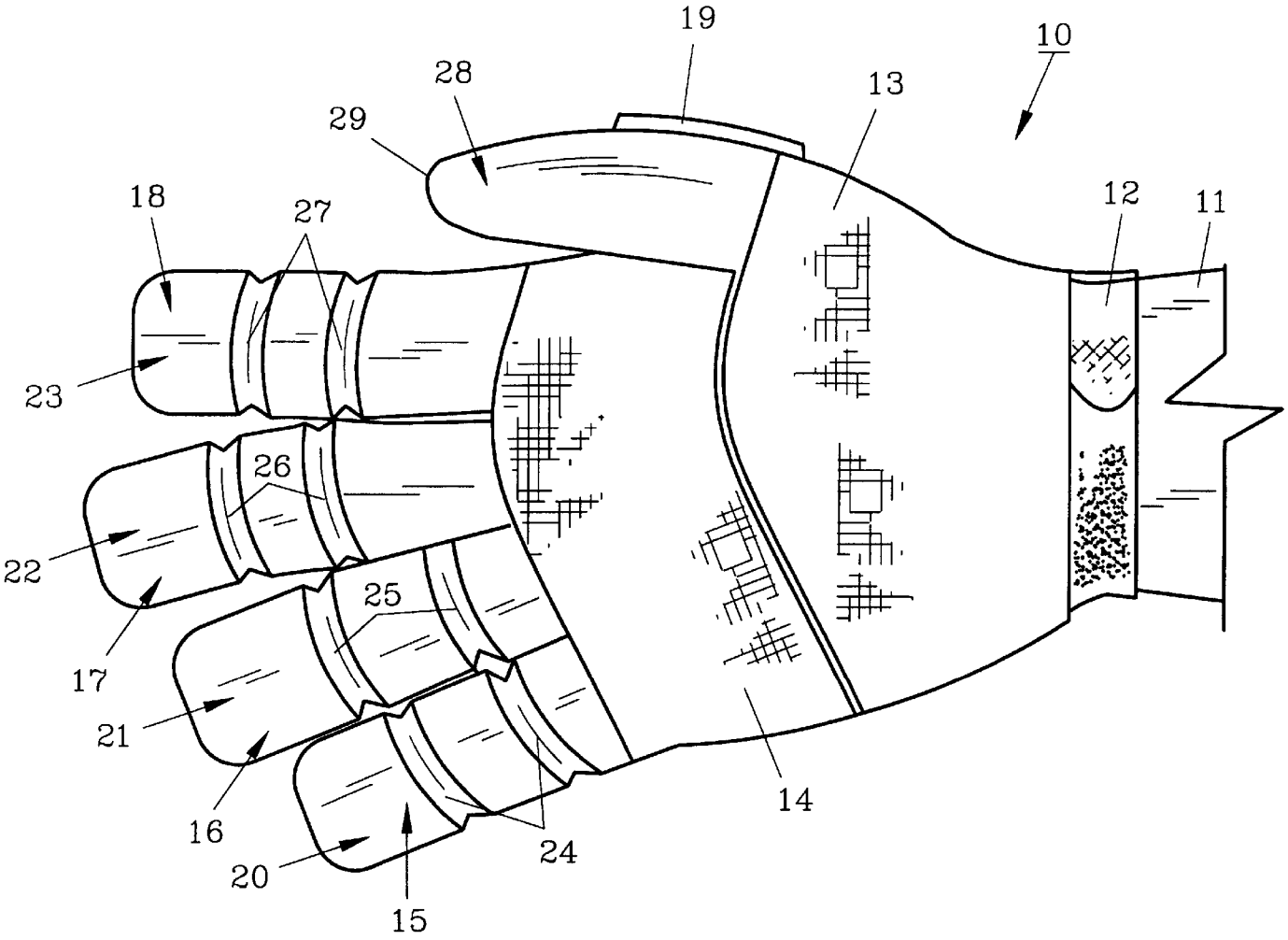
FIG. 2 illustrates the back of an off hand glove.
Figure 3:
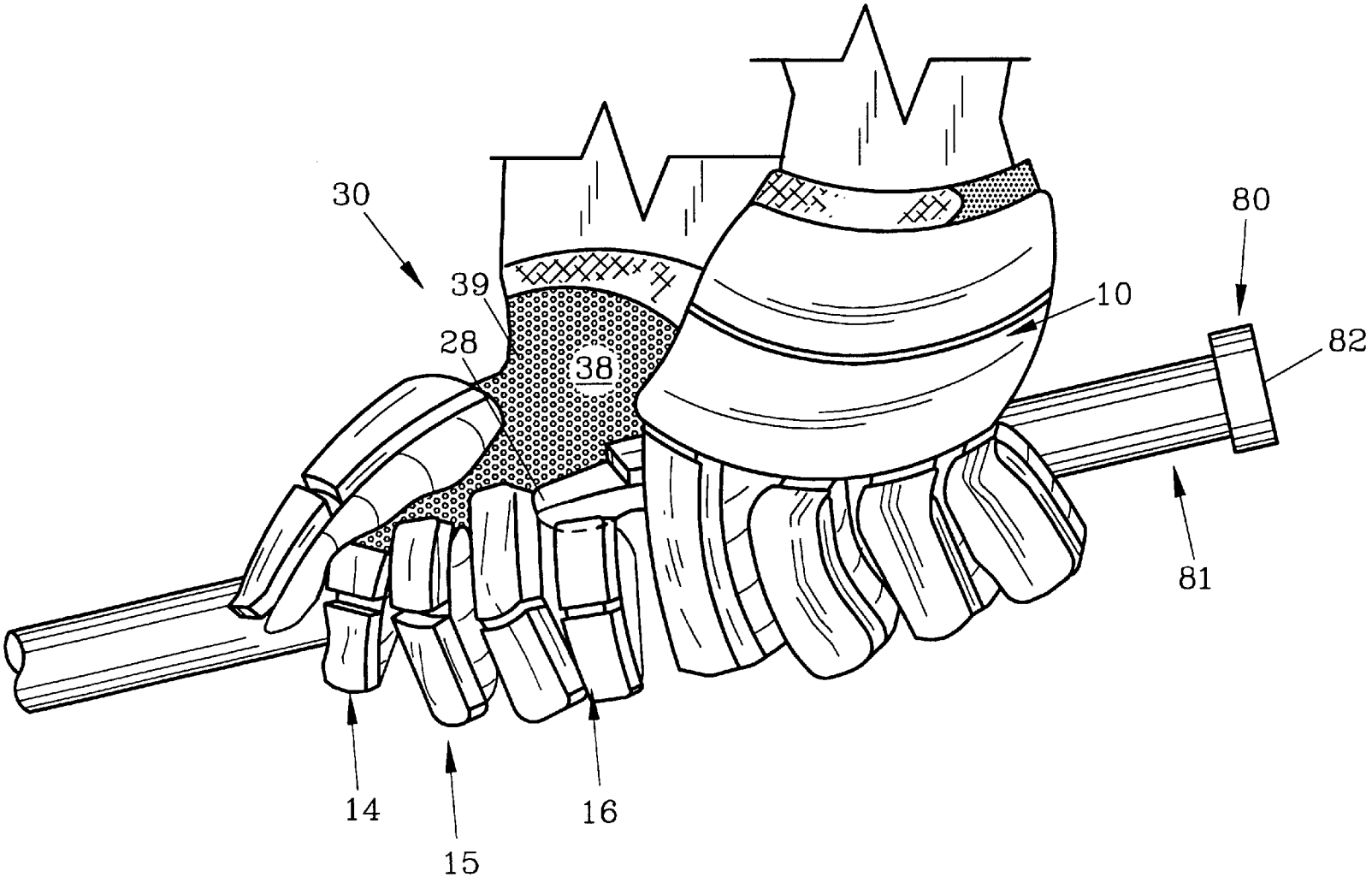
FIG. 3 demonstrates the pair of gloves grasping the end of a bat.

Turning now to the drawings, specifically FIG. 2 shows off hand glove 10 which comprises conventional batting glove 11 complete with VELCRO® wrist strap 12. Glove 11 may be leather, a synthetic material or some combination of the two and may be considered a hand sheath. Sewn or otherwise attached to the back of glove 11 are pads 13–19. Pads 13–19 are preferably made from a dense polymeric foam to absorb impact. First pad 13 is proximate the batter's wrist, and more specifically, proximate wrist strap 12. Pad 13 is generally crescent shape. Abutting pad 13, is pad 14 which is also crescent shaped and covers the majority of the back of the batter's hand. Finger pads 15–18 each include terminal ends 20–23 and knuckle joints 24–27 respectively. Joints 24–27 are formed by either pressure forming the pads or by removing a small wedge of the pad. Joints 24–27 allow the fingers (not shown), specifically the knuckle areas of the batter's hand (also not shown) to bend around and grasp a bat, such as bat 80 (FIG. 3). Thumb pad 19 is shorter than thumb sleeve 28 of glove 11, thus exposing distal end 29 of thumb sleeve 28 so the thumb fits under the dominant hand.

Figure 1:
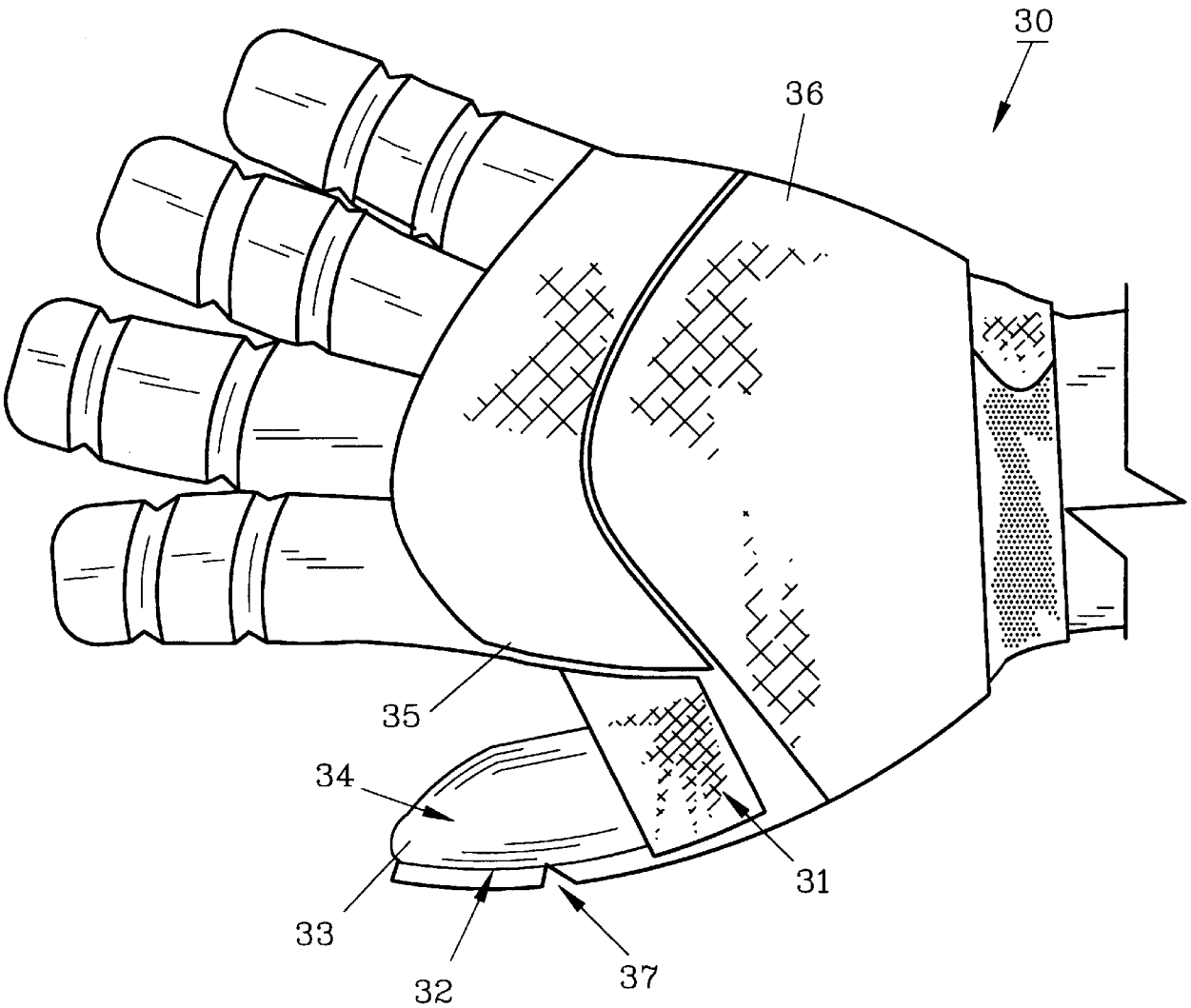
FIG. 1 shows the back of a dominant hand glove.

Dominant hand glove 30, seen in FIG. 1, is substantially identical to off hand glove 10. The exceptions are the addition of web pad 31 positioned over the webbing between the batter's thumb and forefinger and the extension of thumb pad 32 to distal end 33 of thumb sleeve 34. Web pad 31 is sewn to thumb pad 32 and to exterior edge 35 of back pad 36. Because thumb pad 32 now covers the knuckle of the batter's thumb, joint 37 is included to facilitate easy bending thereof.

As seen in FIG. 3, glove 10 and glove 30 are preferably used in combination around haft 81 of bat 80. In use, off hand glove 10 is positioned closer to end 82 of bat 80 with exposed thumb sleeve 28 pointing away from end 82 along the longitudinal axis of bat 80. Dominant hand glove 30 is positioned atop off hand glove 10, specifically over exposed thumb sleeve 28 thereby protecting the same. Web pad 31 is now away from the pitcher, safely protected by bat 80. As shown in FIG. 3, gloves 10 and 30 may also include flexible, resilient polymeric foam 39 on palms 38 (only one shown) thereof. Foam 39 allow increased frictional contact between gloves 10 and 30 and bat 80 and provide shock absorption when the ball is hit. This method of holding a bat is extremely useful in teaching batters proper stance and technique without fear of injury to the hands since the pads cover all exposed portions of the hands down to the wrists.

The preceding recitation is provided as an example of the preferred embodiment and the glove shown are for a right handed batter. Gloves for a left handed batter would produced as a mirror image thereof. The examples shown are not meant to limit the nature of scope of the present invention or appended claims.

I claim:

1. A pair of gloves in combination, said pair of gloves comprising a dominant hand glove and an off hand glove, said off hand glove comprising:

a) a hand sheath, said hand sheath comprising a back and a thumb sheath, said thumb sheath having a distal end;

b) a first pad, said first pad covering a portion of said back of said hand sheath; and c) a second pad, said second pad covering a portion of said thumb sheath so that said distal end is exposed; and said dominant hand glove comprising:

a) a hand sheath, said hand sheath comprising a back;

b) a first pad, said first pad covering a portion of said back of said hand sheath;

c) a plurality of finger pads, said finger pads attached to said hand sheath; and d) a web pad, said web pad attached to said hand sheath to cover the juncture between the dominant glove thumb and forefinger.

2. The combination of claim 1 wherein said off hand glove further comprises a plurality of finger pads, said plurality of finger pads attached to said hand sheath.

3. The combination of claim 2 wherein said hand sheaths of both said off hand glove and said dominant hand glove comprise knuckle areas, said finger pads of both said off hand glove and said dominant hand glove comprise joints, said joints positioned at said knuckles areas of said hand sheaths.

4. A pair of gloves in combination, said pair of gloves comprising a dominant hand glove and an off hand glove, said dominant hand glove comprising:

a) a hand sheath, said hand sheath comprising a back, a thumb sleeve and a forefinger sleeve;

b) a first pad, said first pad attached to said back;

c) a plurality of finger pads, said plurality of finger pads attached to said hand sheath; and d) a web pad, said web pad spanning said hand sheath from said thumb sleeve to said forefinger sleeve; and said off hand glove comprising:

a) a hand sheath, said hand sheath comprising a back;

b) a back pad, said back pad attached to the back of said hand sheath; and c) at least one finger pad, said finger pad attached to said hand sheath.

5. The combination of claim 4 wherein said pair of gloves each further comprise a plurality of finger joints, said finger joints positioned in said finger pads.

6. The combination of claim 4 wherein the hand sheath of said off hand glove further comprises a thumb sleeve and a thumb pad, said thumb pad attached to said thumb sleeve, said thumb sleeve comprising a distal end, said thumb pad leaving said distal end exposed.

7. The combination of claim 4 wherein said pads are formed from a polymeric foam.

8. The combination of claim 4 wherein each of said hand sheaths further comprises a palm area, said palm area covered by a polymeric foam.

9. A method of holding a bat with a pair of gloved hands, said method comprising the steps of:

a) grasping the haft of a bat with an off hand glove which provides an exposed thumb of the wearer;

b) extending the exposed thumb upwardly along said haft; and c) grasping the haft of said bat with a dominant hand glove having a web pad which covers the juncture between the dominant hand glove thumb and forefinger, thereby covering said exposed thumb.

* * * * *